US006717342B2

(12) United States Patent
Kim et al.

(10) Patent No.: US 6,717,342 B2
(45) Date of Patent: Apr. 6, 2004

(54) SHADOW MASK IN COLOR CRT

(75) Inventors: Yeoung Ku Kim, Kyongsangbuk-do (KR); Sang Mun Kim, Kyongsangbuk-do (KR); Yoon Lae Cho, Taegu-shi (KR)

(73) Assignee: LG Electronics Inc., Seoul (KR)

( * ) Notice: Subject to any disclaimer, the term of this patent is extended or adjusted under 35 U.S.C. 154(b) by 60 days.

(21) Appl. No.: 09/939,557

(22) Filed: Aug. 28, 2001

(65) Prior Publication Data

US 2002/0043917 A1 Apr. 18, 2002

(30) Foreign Application Priority Data

Aug. 29, 2000 (KR) ..... 2000-50435
Dec. 27, 2000 (KR) ..... 2000-83090

(51) Int. Cl.[7] ..... H01J 29/07
(52) U.S. Cl. ..... 313/402; 313/403
(58) Field of Search ..... 313/402, 403; 427/68

(56) References Cited

U.S. PATENT DOCUMENTS 3,760,214 A * 9/1973 Yamazaki et al. ..... 313/402
4,442,376 A * 4/1984 Van Der Waal et al. .... 313/402
5,733,163 A * 3/1998 Kim et al. ..... 313/402
5,841,223 A * 11/1998 Muramatsu et al. ..... 313/402
6,063,434 A * 5/2000 Rho et al. ..... 427/68
6,320,306 B1 * 11/2001 Heine et al. ..... 313/402

FOREIGN PATENT DOCUMENTS

| | | | |
|---|---|---|---|
| EP | 0 139 379 | 6/1988 | |
| JP | 52-141170 | 11/1977 | |
| JP | 59-015861 | 1/1984 | |
| JP | 04-048530 | * 2/1992 | ..... 445/47 |
| KR | 10-0205137 | 4/1999 | |
| KR | 10-0205138 | 4/1999 | |
| KR | 1997-0063326 | 4/1999 | |
| KR | 1998-071999 | 6/2001 | |
| WO | WO 97/29504 | 8/1997 | |

* cited by examiner

*Primary Examiner*—Ashok Patel
(74) *Attorney, Agent, or Firm*—Fleshner & Kim, LLP

(57) ABSTRACT

Shadow mask in a color CRT including an electron reflective film formed, starting from a surface of the shadow mask, down to an inside surface of each of holes, or an electron reflective film formed on a surface of the shadow mask facing an electron gun, or on the surface of the shadow mask and an inside tapered surfaces of holes of the shadow mask and another electron reflective film formed on a surface of the electron reflective film formed on the shadow mask facing an electron gun, thereby reducing thermal deformation of the shadow mask, with a consequential reduction of doming, that prevents mislanding of the electron beams, color dispersion of the color CRT, to improve a color purity.

20 Claims, 6 Drawing Sheets

SHADOW MASK IN COLOR CRT

BACKGROUND OF THE INVENTION

1. Field of the Invention

The present invention relates to a shadow mask, and more particularly, to a shadow mask in a color CRT (Cathode Ray Tube) having an electron reflective film on a surface thereof opposite to an electron gun for prevention of doming.

2. Background of the Related Art

Referring to FIG. 1, a related art color CRT is provided with a panel 1 having a coat of fluorescent film 3 applied to an inside surface thereof, a funnel 2 welded to the panel 1 with fusion glass having a coat of conductive graphite applied to an inside surface thereof, and an electron gun 6 in a neck portion 4 of the funnel 2 for emitting three electron beams 5 corresponding to the 3 colors. There is a shadow mask 7, a color selecting electrode, having a plurality of slots or dotted holes opposite to, and in the vicinity of the fluorescent film 3 supported by a frame 8, and there is a deflection yoke 9 on an outer circumference of the funnel for deflection of electron beams in left and right directions. There is an inner shield 10 fitted to rear side of the frame, when seen from a panel side, for prevention of deflection of the electron beam by an influence of geomagnetism when the electron beams pass through the hole in the shadow mask and reach to the fluorescent film.

In general, as shown in FIG. 2, a hole of the shadow mask has a section enlarged both in an electron gun direction and a fluorescent film direction.

Upon reception of a video signal at the electron gun 6, in the foregoing CRT, thermal electrons are emitted from cathodes of the electron gun, and travel toward the panel as the electrons pass through acceleration and focusing processes by voltages applied to electrodes in the electron gun. A path of the electron beam 5 is controlled by a magnetic field of a magnet fitted to a neck portion 4 of the funnel 2, and directed onto the inside surface of the panel by the deflection yoke 9, of which approx. 20% pass through the hole in the shadow mask and is involved in color selection, by hitting onto the fluorescent film 3 on the inside surface of the panel, to make the fluorescent film luminant, that reproduces the video signal.

In the meantime, the rest 80% of the electron beam hits on a surface of the shadow mask, to raise a temperature of the shadow mask accompanied by a thermal expansion of the shadow mask, to cause doming in which a landing position of the electron beams are varied with an extent of bulge of the shadow mask, that makes a color purity of a picture poor.

In order to solve this problem, a length and welding points and the like of the shadow mask are varied in the related art to shift position of the shadow mask near to, or away from, the fluorescent film, to adjust a distance between the fluorescent film and the shadow mask, for compensation of doming.

However, since the compensation of doming in the shadow mask is made in a state the doming is steady when the shadow mask completes thermal expansion, an initial deterioration of resolution caused by initial doming can not be prevented.

In order to prevent occurrence of the doming, U.S. Pat. Nos. 674,934, 4,528,246, and JP laid open patent S59-15861 suggest to use invar steel as a material for the shadow mask. Though the shadow mask of invar steel can reduce a thermal expansion of the shadow mask, the shadow mask has problems in that cost is high with poor economy, and machinability is very poor to require annealing at an elevated temperature higher than 900°, and heating a mold therefor in forming the shadow mask.

EP 0139379 suggests a method for reducing a thermal expansion of the shadow mask, in which a coat of a material having a low thermal expansion, such as lead or borate, is applied to a surface of the shadow mask, and, as another method for preventing doming, a method for coating a thermal insulating material which has an excellent thermal insulating property is known. This method prevents transmission of a heat caused by the electron beam to the shadow mask. In this instance, a material of ceramic is mostly used as the insulating material.

As another method, a method is suggested, in which a coat of a material having an excellent thermal emissivity is applied to a surface of the shadow mask, or a surface of the shadow mask is blackened, for enhancing a thermal emission rate, and a Korea Patent No. 85-1589 to Philips suggests application of a coat of aqueous suspension containing a electron reflective material on a surface of an electron gun.

As another method, a method for coating a thermal insulating material, a thermal emissive material, or an electron reflective material on the surface of the shadow mask or the electron gun by spray or sputtering has been used. However, even with a precise control of the spray, a part of the shadow mask holes are plugged frequently, and the surface coated by this method is not even. The shadow mask having the sputtering method applied thereto has a thin coat, and a deposition equipment therefore is expensive and has a poor productivity.

Korea laid open patent Nos. 97-63326, 98-66424, 98-66425, 98-71999, and EP WO97-29504 disclose development of a screen printing composition having 30–78% of $WO_3$ or $Bi_2O_3$ as an electron reflective material, and carbon, a manganese oxide, or an aluminum oxide as the thermal emissive material, for screen printing on the shadow mask to reduce doming and improve the hole plugging by forming an even film. It is understood that there is much room for achieving the improvement of the doming by development of new electron reflective materials, rather than using the related art methods and different from the foregoing patents.

However, referring to FIG. 2, the related art electron reflective film 11 mostly on a surface 13 of the shadow mask outside of the hole 12 facing the electron gun shows doming when the electron beams hit onto the inside surfaces 14 of the holes as shown in FIG. 3.

SUMMARY OF THE INVENTION

Accordingly, the present invention is directed to a shadow mask in a color CRT that substantially obviates one or more of the problems due to limitations and disadvantages of the related art.

An object of the present invention is to provide a shadow mask in a color CRT, in which electron reflective films are formed, not only on an outer surface of the shadow mask, but also on an inside surfaces of holes in the shadow mask, to reduce thermal deformation of the shadow mask caused by electron beam hitting on the surface of the shadow mask, with a consequential suppression of the doming, thereby preventing mislanding of the electron beams and color dispersion of the color CRT to improve color purity.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the shadow mask in a color CRT includes an electron reflective film formed, starting from a surface of the shadow mask, down to an inside surface of each of holes.

In another aspect of the present invention, there is provided a shadow mask in a color CRT including an electron reflective film formed on a surface of the shadow mask facing an electron gun, or on the surface of the shadow mask and an inside tapered surfaces of holes of the shadow mask, and another electron reflective film formed on a surface of the electron reflective film formed on the shadow mask facing an electron gun.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
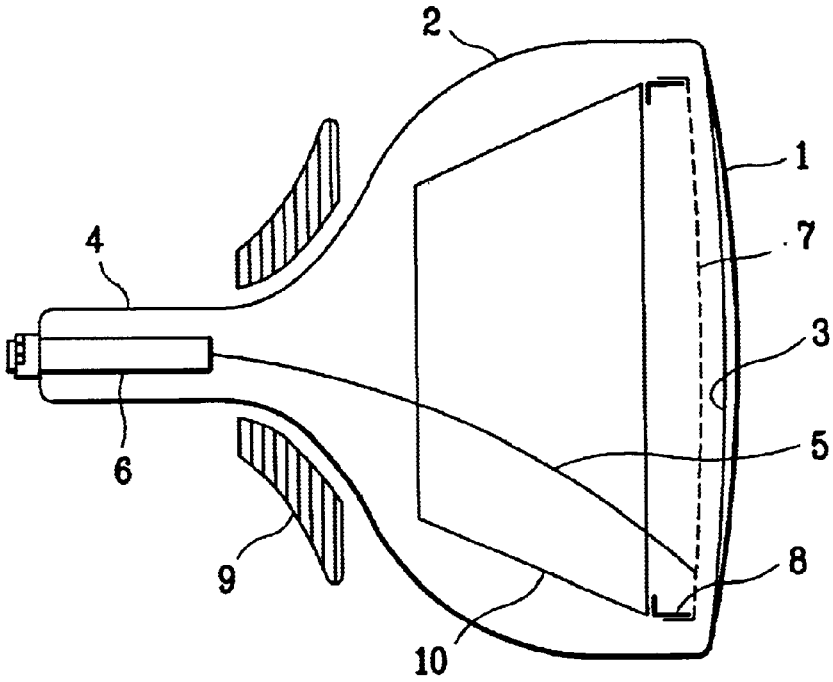
FIG.1 Related Art
FIG. 1 illustrates a section of a related art color CRT, schematically.
Figure 2:
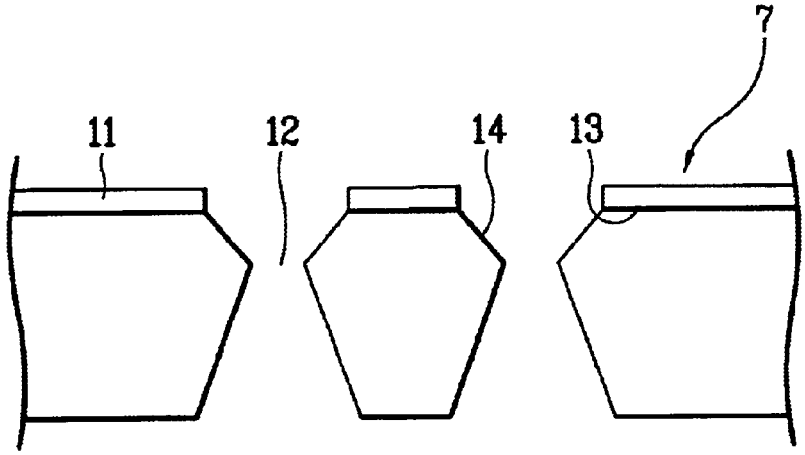
FIG.2 Related Art
FIG. 2 illustrates a section a related art shadow mask having an electron reflective film applied thereto.
Figure 3:
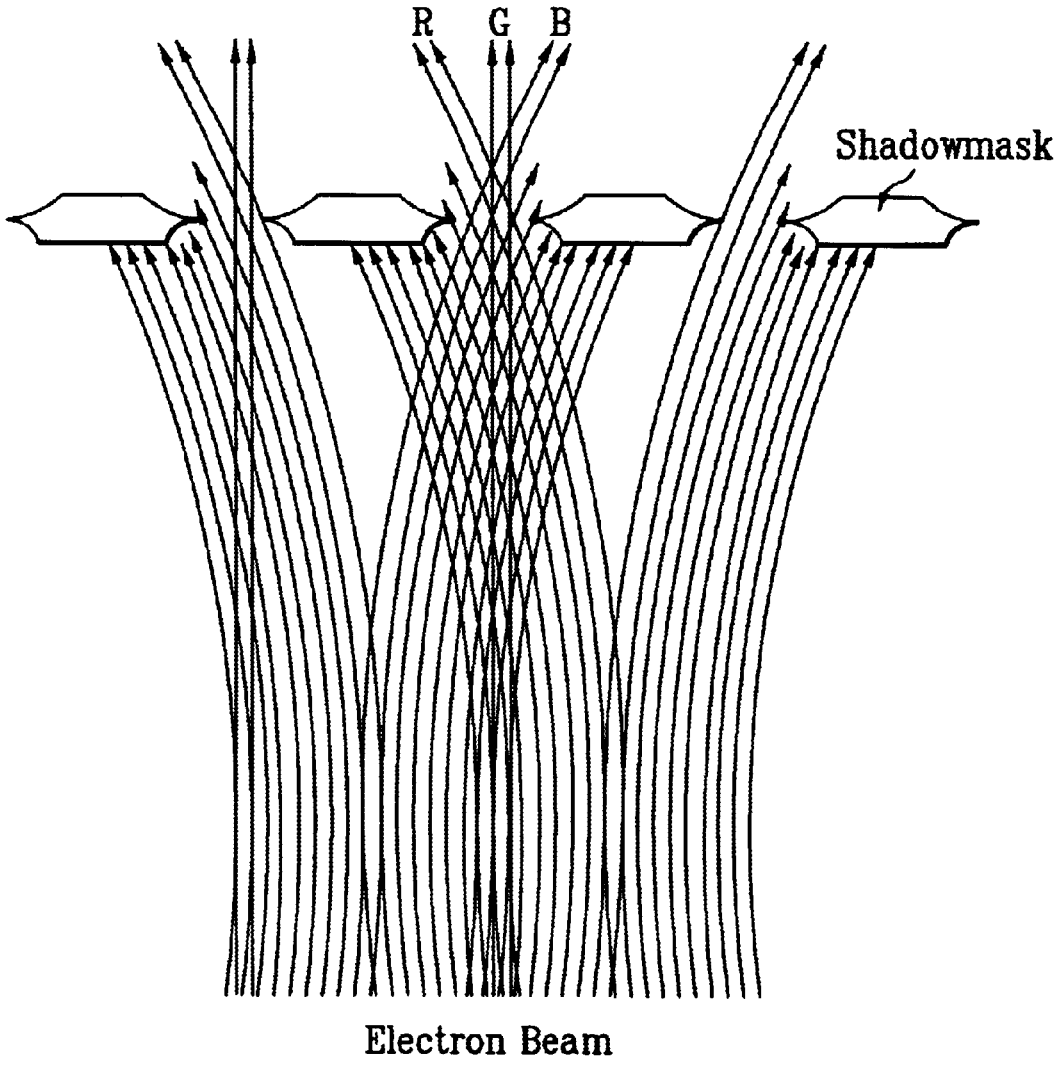
FIG.3 Related Art
FIG. 3 illustrates a section of a shadow mask showing paths of electron beams.
Figure 4:
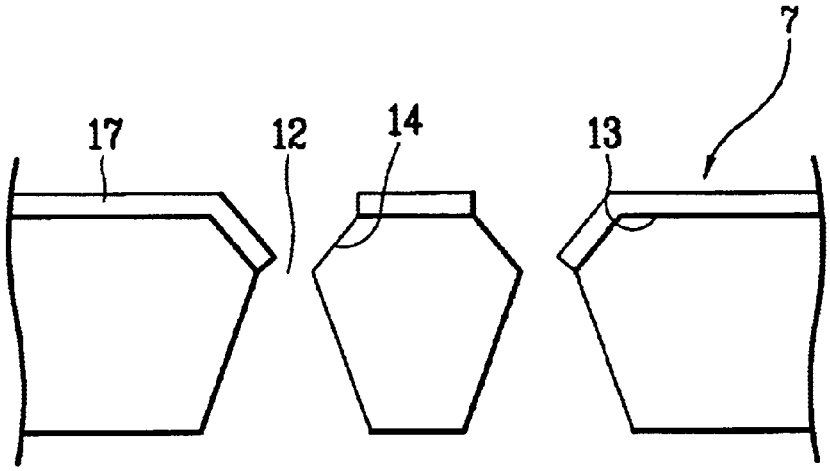
FIG. 4 illustrates a section of a shadow mask in a color CRT having a coat of electron reflective film applied thereto in accordance with a first preferred embodiment of the present invention.

Reference will now be made in detail to the preferred embodiments of the present invention, examples of which are illustrated in the accompanying drawings. FIG. 4 illustrates a section of a shadow mask in a color CRT having a coat of electron reflective film applied thereto in accordance with a first preferred embodiment of the present invention. The shadow mask in a color CRT in accordance with a first preferred embodiment of the present invention includes a coat of electron reflective film 17 on a surface 13 of the shadow mask, inclusive of an inside surface 14 of each of holes, of a paste having composition with 50–70 wt parts of tungsten oxide $WO_3$, bismuth oxide $Bi_2O_3$, or lead oxide PbO powder, 15–20 wt parts of Frit glass, and 10–30 wt parts of solvent, applied thereto by printing. 0.1–10 wt parts of graphite powder may be added to the paste composition.

In electron reflective materials, materials each having a great electron reflective effect when the electron beam hits onto the surface 13 of the shadow mask, there are tungsten, bismuth, lead, and the like, and oxides thereof. The oxides have a great electron beam reflective ratio of 0.45–0.50, to reduce electron beam absorption, that in turn reduces an amount of doming, i.e. bulge of the shadow mask. The oxides of tungsten and the bismuth have high heat emissivities '$\epsilon$', i.e., the tungsten oxide has a thermal emissivity of $\epsilon$=0.9, and the bismuth oxide has a thermal emissivity of $\epsilon$=0.85.

Frit glass with a thermal expansion coefficient of approx. 110×10–6, is printed, dried, and heated at an elevated temperature of approx. 500–600° C., for fusion welding the electron reflective material to the surface 13 of the shadow mask.

It is required to adjusts physical properties of the printing paste for forming the electron reflective film 17 starting from the surface 13 of the shadow mask 7 down to an inside surfaces 14 of the holes. That is, in order to improve a thixtropy, a fluidity of a paste, a vehicle like solvent, Frit glass, glass raw material, and an electron reflective material or an insulating material are introduced into a roll mill together, and mixed uniformly for more than two hours by using disperser or the like. In this instance, kind and amount of solvent is important for controlling viscosity of the paste. The properties of the printing paste required for forming the electron reflective film 17 are a viscosity of approx. 10,000–50,000 c.p.s level, and a thixtropy, represented as ratios of viscosity 10 r.p.m and 50 r.p.m, of 2–7, most appropriately.

Figure 5:
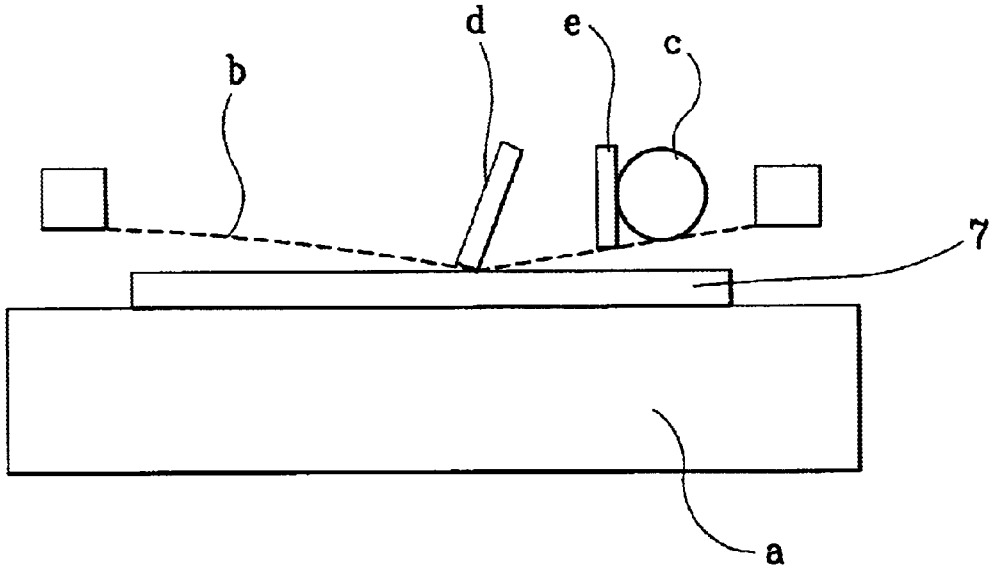
FIG. 5 illustrates a process for forming an electron reflective film on a shadow mask.

Referring to FIG. 5, in formation of the electron reflective film 17, a shadow mask 7 is placed on a printing substrate 'a', an electron reflective film is formed of paste 'c' of the above composition on a screen mesh 'b' by using a squeeze 'd' and scraper 'e' and dried at approx. 80–150° C. Then, the shadow mask is heat treated at approx. 550–600° for approx. 30 min. in an electric furnace having air and city gas introduced therein to form a blackened film on the surface of the shadow mask, thereby completing formation of the electron reflective film 17.

Figure 6A:
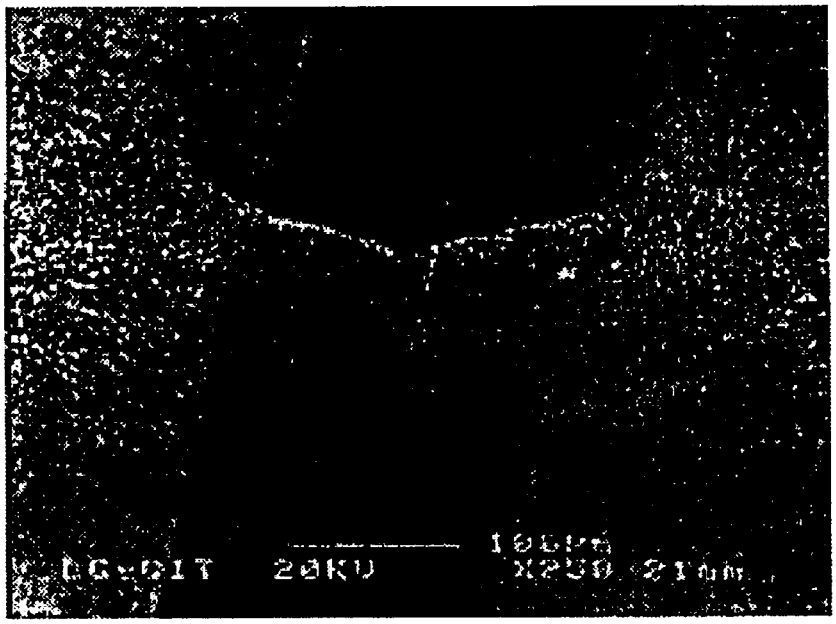
FIG. 6A illustrates a section of a shadow mask having an electron reflective film formed thereon in accordance with a preferred embodiment of the present invention.
Figure 6B:
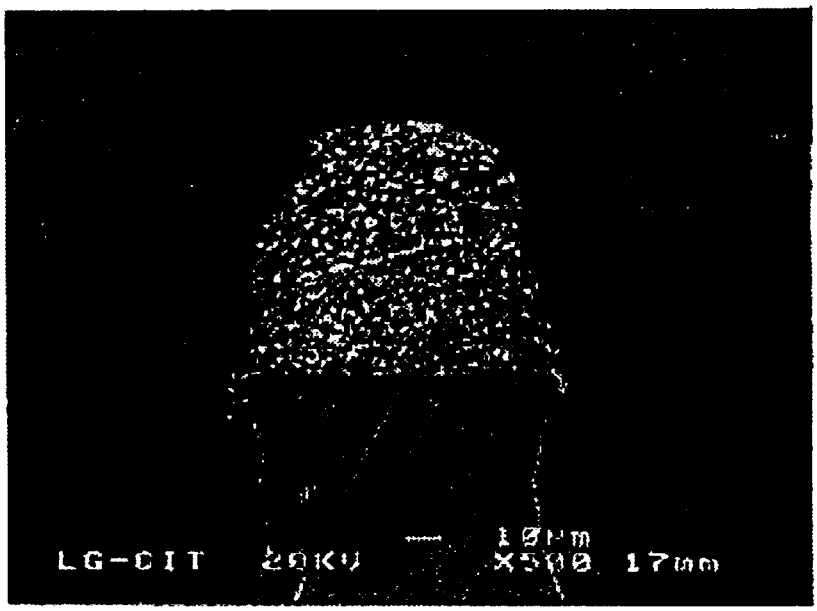
FIG. 6B illustrates a section of a shadow mask having an electron reflective film formed on a tapered surface thereof in accordance with a preferred embodiment of the present invention.

FIG. 5 illustrates one exemplary process for forming an electron reflective film, and the present invention can be embodied by other methods, such as deposition. FIG. 6A illustrates a section of a shadow mask having the electron reflective film 17 of the present invention formed thereon, and FIG. 6B illustrates a state the electron reflective film 17 is formed down to an inside surface 14 of the holes in the shadow mask.

EMBODIMENT 1

A paste is prepared, having a composition with 50–70 wt parts of tungsten oxide $WO_3$ bismuth oxide $Bi_2O_3$, or lead oxide PbO powder, 15–20 wt parts of Frit glass, and balance of a vehicle, a solvent. Then, as shown in FIG. 5, the paste is printed on an annealed shadow mask of AK material to a thickness of approx. 10–60 $\mu$m, and dried at a temperature ranging approx. 80–150° C. A surface of the shadow mask is blackened at approx. 600° C., to complete formation of the shadow mask.

Figure 7:
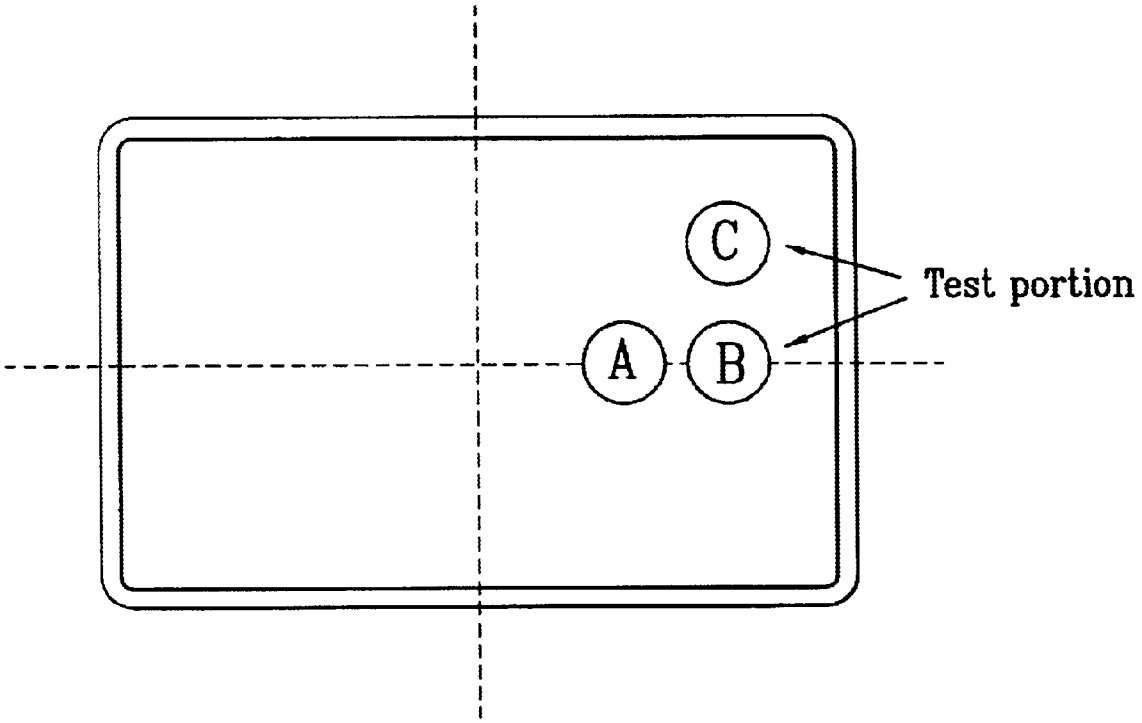
FIG. 7 illustrates doming assessment points.

Doming reductions are measured at points shown in FIG. 7 for the shadow mask fabricated thus and applied to a 25" color CRT. A result of measurements at 'A' point in FIG. 7, a maximum doming point in the color CRT, are shown in table 1, below, for comparison.

EMBODIMENT 2

0.1–10 wt parts of graphite powder is added to the paste of the first embodiment, in fabrication of a shadow mask following an identical process as the first embodiment, to obtain a result as shown in table 1.

As can be known from table 1, though the shadow mask without coating on the inside surface of hole shows a doming reduction approx. 44%, the shadow mask of the present invention having the electron reflective film formed on the inside surface of the hole shows an additional 12–24% enhancement, resulting to have a doming reduction effect of maximum 68% compared to an AK material shadow mask without the electron reflective film.

TABLE 1

| AK | Embodiment 1 | | Embodiment 2 | No coat on inside of hole |
|---|---|---|---|---|
| Max. Doming (μm) | 125 | 55 | 40 | 70 |
| Reduction eff. | — | 56 | 68 | 44 |

Figure 8A:
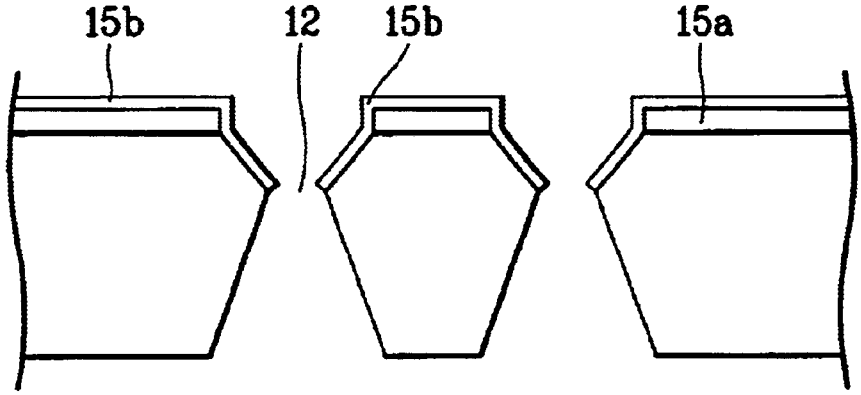
FIG. 8A illustrates a section of a shadow mask having a bilayered electron reflective film formed thereon in accordance with another embodiment of the present invention; and, FIG. 8B illustrates a section of a shadow mask having a bilayered electron reflective film formed thereon in accordance with another embodiment of the present invention.

FIG. 8A illustrates another embodiment of the present invention, wherein an electron reflective film 15*a* is formed on a surface of a shadow mask facing an electron gun, and another electron reflective film 15*b* is formed on the electron reflective film 15*a* and on a tapered inside surface of each of holes 12 in the shadow mask. Eventually, there is a bilayered electron reflective film formed on the surface of the shadow mask, and a single layered electron reflective film formed on the tapered inside surface thereof.

Figure 8B:
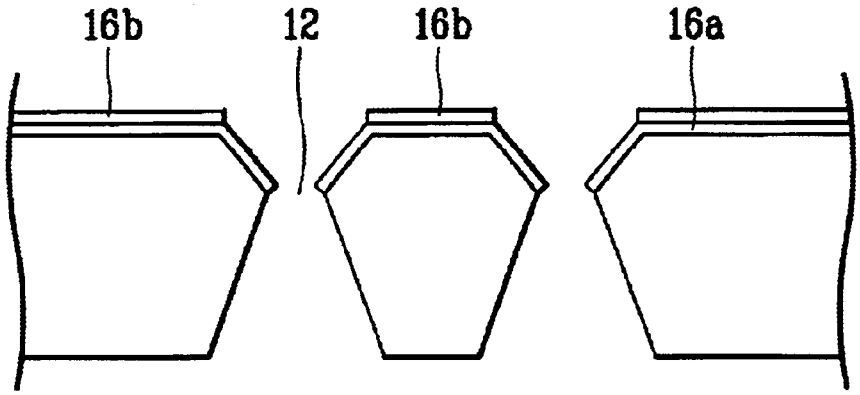

Referring to FIG. 8B, in another embodiment of the present invention, an electron reflective film 16*a* is formed on a surface of a shadow mask facing the electron gun and on a tapered surface of each of holes, and another electron reflective film 16*b* is formed on a surface of the electron reflective film 16*a* over the surface of the shadow mask facing the electron gun. Eventually, the embodiment shows a bilayered electron reflective film on the surface of the shadow mask, while single layered electron reflective film is formed on the tapered inside surface of each of holes in the shadow mask.

Either the screen printing or the deposition may be applied at first in formation of the electron reflective film. The electron reflective material may be selected from a group of materials including $WO_3$, $Bi_2O_3$, PbO, $Pb_{2-x}WO_{5-x}$, $CaWO_4$, and $MgWO_4$ of the related art. The composition of the paste is 100 wt parts of at least one selected from $WO_3$, $Bi_2O_3$, PbO, $Pb_{2-x}WO_{5-x}$, $CaWO_4$, and $MgWO_4$, 40–70 wt parts of Frit, an enamel, and 30–60 wt parts of vehicle.

An amount of the Frit greater than 70 wt parts in the paste causes a higher viscosity, leading, not only to difficulty in screen printing, but also to a poor adhesive force, and an amount of the Frit lower than 40 wt parts causes a low viscosity, leading to occur hole plugging of the shadow mask in the screen printing.

An amount of the vehicle lower than 30 wt parts causes a higher viscosity, leading, not only to difficulty in printing, but also a poor adhesive force of the electron reflective film after the film is dried, and an amount of the vehicle greater than 60 wt parts causes a low viscosity of the printing composition, that may cause hole plugging of the shadow mask in printing.

The vehicle may be prepared as follows. A solvent with a 180–250° C. of volatile point is used for dissolving an organic binder in the vehicle, such as butylcarbitol, butylcarbitolacetate, and etc., and butylacetate and etc., may be used as an additive to be added thereto. As the organic binder, ethyl cellulose, nitrocellulose, epoxy, and etc., may be used. The vehicle is required to have a viscosity of 5,000–10,000 cps, and, if the viscosity is below 3000 cps, the viscosity is so low to cause hole plugging of the shadow mask when the paste is applied to the surface of the shadow mask for printing, and, if the viscosity is higher than 10,000 cps, the viscosity is too high to print. The screen printing composition is prepared by introducing an inorganic raw material into the solvent, kneading by a mixer, and mixing by a three set roller. The screen printing composition prepared thus is screen printed on a surface of the annealed shadow mask facing the electron gun, to form a coat. In the screen printing, the screen printing composition passes through eyes of the net, and coated on the surface of the shadow mask.

A graphic arts plate used in the printing may be of stainless steel or silk, or unpatterned net screen. The coated film has a thickness of 5–40 μm, and, if the thickness is below 5 μm, the electron reflection effect is poor, and if the thickness is greater than 40 μm, the holes may be plugged, the film may be peeled off during the film is dried, and the fluorescent film may be uneven. Thus, after fabricating the shadow mask by forming and drying the screen printing film on the shadow mask, the shadow mask is subjected to blackening in a 600° C. city gas environment, to complete fabrication of the shadow mask.

As a deposition material of the electron reflection, a material having a low melting point is preferable, inclusive of the aforementioned electron reflective material, such as Pb or Bi. The deposition is conducted at a vacuum of $10^{-10}$–$10^{-7}$ Torr. The deposition film has a thickness ranging 0.01–1 μm, and, if the thickness is below 0.01 μm, it is difficult to expect an effect of the electron reflective film, and, if the thickness is greater than 1 μm, the hole sizes of the shadow mask become smaller, to cause interference of the electron beams, making a color purity poor.

In succession of the blackening after formation of the electron reflective film, a fluorescent film is formed on the panel, the funnel is fitted to the panel, and sealed, to complete fabrication of the CRT.

EMBODIMENT 3

At first, butyl carbitol solvent with a volatile point higher than 180 is measured, ethylcellulose, a polymer adhesive, is dissolved therein, to prepare 40 wt parts of vehicle having a viscosity of 10,000 cps. 100 wt parts of $WO_3$ electron reflective material, and 50 wt parts glass are introduced into the vehicle as an inorganic raw material, and mixed, and spread uniformly by a three set roller. The screen printing composition prepared thus is applied to the shadow mask of AK steel having hydrogen annealing process applied thereto at a temperature range of 800–870° C., to form a coat of electron reflective film as shown in FIG. 8A. That is, after screen printing, and drying an electron reflective film 15*a* of 10 μm thickness on a surface of the shadow mask (an outer surface except inside surface of holes) facing the electron gun, the shadow mask is blackened at 600° C. city gas environment. Then, a coat of bismuth is deposited on the printed film on the surface of the shadow mask and inside surfaces of the holes to a thickness of 0.2 μm, to obtain an electron reflective film 15*b*, thereby completing fabrication of the shadow mask, which is then used in 29" color CRT.

EMBODIMENT 4

At first, butyl carbitol solvent with a volatile point higher than 180 is measured, ethylcellulose, a polymer adhesive, is dissolved therein, to prepare 40 wt parts of vehicle having a viscosity of 10,000 cps. 100 wt parts of $WO_3$ electron reflective material, and 50 wt parts glass are introduced into the vehicle as an inorganic raw material, and mixed, and spread uniformly by a three set roller. The screen printing composition prepared thus is applied to the shadow mask of AK steel having hydrogen annealing process applied thereto at a temperature range of 800–870° C., to form a coat of electron reflective film as shown in FIG. 8B. That is, after sputtering $WO_3$ an electron reflective film 16*a* on a surface of the shadow mask (an outer surface of the shadow mask and the inside surface of holes) facing the electron gun, a coat of 10 μm identical electron reflective material is screen printed and dried on a surface of the shadow mask (an outer surface except inside surface of holes on a surface the electron reflective film is coated) facing the electron gun to form an electron reflective film 16*b*, and the shadow mask is blackened at 600° C. city gas environment, thereby completing fabrication of the shadow mask, which is then used in 29" color CRT.

Comparative Example 1

Screen printing composition of an electron reflective material identical to the third embodiment is screen printed on a surface of a shadow mask of AK steel facing the electron gun, to form a 10 μm thick printed film, and the film is dried and blackened at 600° C. city gas environment, thereby completing fabrication of a shadow mask, which is then used in a 29" color CRT.

Comparative Example 2

$Bi_2O_3$ is dispersed in water, and water glass is added thereto, and agitated, to prepare $Bi_2O_3$ suspension. Then, a shadow mask is disassembled from a panel having fluorescent material applied thereto and a frame fitted thereto, and the $Bi_2O_3$ suspension is sprayed to a surface of the shadow mask facing an electron gun, and fitted to the panel, to fabricate a color CRT.

Maximum doming of the shadow mask of the embodiment and the comparative example are assessed, at a point 12 cm away from a center of screen in 3 o'clock direction.

A doming effect (D.E) is calculated according to the following equation.

D.E mislanding (no coating)−mislanding (coating)/mislanding (no coating), where, mislanding (no coating) denotes a mislanding occurred when a shadow mask without an electron reflective film is used, and mislanding (coating) denotes a mislanding occurred when a shadow mask with an electron reflective film is used.

A result of doming assessment is shown in table 2, below.

TABLE 2

| | Embodiments | | Comparative examples | |
|---|---|---|---|---|
| | 1 | 2 | 1 | 2 |
| Doming characteristic (μm) | 34 | 39 | 50 | 60 |
| Doming effect (%) | 65 | 59 | 47 | 37 |

As has been explained, the shadow mask in a color CRT of the present invention has the following advantages.

The bilayered electron reflective film on a surface of the shadow mask facing the electron gun, and a single layered electron reflective film on a tapered inside surfaces of holes in the shadow mask reduces doming, thereby preventing color dispersion and improving picture quality.

It will be apparent to those skilled in the art that various modifications and variations can be made in the shadow mask in a color CRT of the present invention without departing from the spirit or scope of the invention. Thus, it is intended that the present invention cover the modifications and variations of this invention provided they come within the scope of the appended claims and their equivalents.

What is claimed is:

1. A shadow mask in a color CRT, comprising:

a first electron reflective film layer formed on a surface of the shadow mask facing an electron gun and on inside tapered surfaces of holes of the shadow mask facing the electron gun; and a second electron reflective film layer formed on a surface of the first electron reflective film layer formed on a surface of the shadow mask facing the electron gun.

2. The shadow mask as claimed in claim 1, wherein at least one of the electron reflective film layers comprises a coating formed of a paste, the paste having a composition of at least 50–70 wt parts of tungsten oxide $WO_3$, bismuth oxide $Bi_2O_3$, or lead oxide PbO powder, 15–20 wt parts of Frit glass, and 10–30 wt parts of solvent.

3. The shadow mask as claimed in claim 2, wherein the mixed, and composed paste further comprises 0.1–10 wt parts of graphite powder.

4. The shadow mask as claimed in claim 2, wherein the at least one electron reflective film layer has a thickness of approximately 10–60 μm.

5. The shadow mask as claimed in claim 2, wherein the at least one electron reflective film layer is formed by deposition.

6. The shadow mask as claimed in claim 1, wherein one of the first or second electron reflective film layers is formed by screen printing, and the other electron reflective film layer is formed by deposition.

7. The shadow mask as claimed in claim 6, wherein the electron reflective film layer formed by screen printing has a thickness of approximately 5–40 μm.

8. The shadow mask as claimed in claim 6, wherein the electron reflective film layer formed by deposition has a thickness of approximately 0.01–1 μm.

9. The shadow mask as claimed in claim 1, wherein at least one of the electron reflective film layers is formed of a paste, the paste comprising at least one base material selected from $WO_3$, $Bi_2O_3$, PbO, $Pb_{2-X}WO_{5-X}$, $CaWO_4$, and $MgWO_4$.

10. The shadow mask as claimed in claim 9, wherein the paste further comprises Frit glass, an enamel, and a solvent-based vehicle.

11. The shadow mask as claimed in claim 10, wherein the paste comprises 100 wt parts of base material, 40–70 wt parts of Frit glass, and 30–60 wt parts of solvent-based vehicle.

12. The shadow mask as claimed in claim 11, wherein the solvent-based vehicle has a viscosity of 5,000–10,000 cps.

13. A shadow mask in a color CRT, comprising:

a first electron reflective film layer formed on a surface of the shadow mask facing an electron gun; and a second electron reflective film layer formed on a surface of the first electron reflective film layer formed on a surface of the shadow mask facing the electron gun and on inside tapered surfaces of holes of the shadow mask facing the electron gun.

14. The shadow mask as claimed in claim 12, wherein one of the first or second electron reflective film layers is formed by screen printing, and the other layer is formed by deposition.

15. The shadow mask as claimed in claim 14, wherein the electron reflective film layer formed by screen printing has a thickness of approximately 5–40 $\mu$m.

16. The shadow mask as claimed in claim 14, wherein the electron reflective film layer formed by deposition has a thickness of approximately 0.01–1 $\mu$m.

17. The shadow mask as claimed in claim 13, wherein the at least one electron reflective film layers is formed of a paste, the paste comprising at least one base material selected from $WO_3$, $Bi_2O_3$, PbO, $Pb_{2-X}WO_{5-X}$, $CaWO_4$, and $MgWO_4$.

18. A color cathode ray tube, comprising:

a panel having a coat of fluorescent film applied to an inside surface thereof a funnel welded to the panel with fusion glass, the funnel having a coat of conductive graphite applied to an inside surface thereof a neck portion having a coat of conductive graphite applied to an inside surface thereof an electron gun provided in the neck portion; and a shadow mask having a plurality of slots positioned opposite the fluorescent film, wherein an electron reflective film layer is formed from a surface of the shadow mask opposite the neck portion and throughout an inside surface of each of the slots, wherein the electron reflective film comprises PbO, $WO_3$, $Bi_2O_3$, Frit glass, and graphite.

19. The color cathode ray tube of claim 18, wherein the electron reflective film layer has a thickness of approximately 10–60 $\mu$m.

20. The color cathode ray tube of claim 18, wherein the electron reflective film layer is formed by deposition.

* * * * *